US008430245B2

(12) United States Patent
Ziganto

(10) Patent No.: US 8,430,245 B2
(45) Date of Patent: Apr. 30, 2013

(54) INSERT FOR TAPE AND REEL PACKAGING

(75) Inventor: Raymond A. Ziganto, Aurora, IL (US)

(73) Assignee: BI-Link, Inc., Bloomingdale, IL (US)

( * ) Notice: Subject to any disclaimer, the term of this patent is extended or adjusted under 35 U.S.C. 154(b) by 175 days.

(21) Appl. No.: 12/730,709

(22) Filed: Mar. 24, 2010

(65) Prior Publication Data

US 2011/0233109 A1 Sep. 29, 2011

(51) Int. Cl.
*B65D 73/02* (2006.01)
*B65D 85/86* (2006.01)

(52) U.S. Cl.
USPC ..... 206/714; 206/713; 206/722; 206/488

(58) Field of Classification Search ..... 206/714, 206/716, 713, 717, 722, 725, 488, 483, 477, 206/701; 53/474, 473, 475
See application file for complete search history.

(56) References Cited

U.S. PATENT DOCUMENTS

| | | | | |
|---|---|---|---|---|
| 4,606,171 | A | 8/1986 | Ohshima et al. | |
| 4,657,137 | A | 4/1987 | Johnson | |
| 4,724,958 | A | 2/1988 | Kaneko et al. | |
| 5,076,427 | A * | 12/1991 | Thomson et al. | 206/714 |
| 5,199,564 | A * | 4/1993 | Skrtic | 206/714 |
| 5,524,765 | A | 6/1996 | Gutentag | |
| 5,664,680 | A * | 9/1997 | Hamlin | 206/714 |
| 5,769,236 | A * | 6/1998 | Maruyama et al. | 206/714 |
| 5,964,353 | A * | 10/1999 | Hamlin | 206/714 |
| 6,076,681 | A * | 6/2000 | Chenoweth | 206/714 |
| 6,149,010 | A * | 11/2000 | Tanaka et al. | 206/714 |
| 6,389,672 | B1 * | 5/2002 | Ishii et al. | 29/430 |
| 7,143,896 | B2 * | 12/2006 | Susaki | 206/714 |
| 7,296,963 | B2 | 11/2007 | Soto | |
| 7,395,932 | B2 * | 7/2008 | Chew et al. | 206/714 |
| 2001/0002005 | A1 * | 5/2001 | Maruyama et al. | 206/714 |
| 2002/0195372 | A1 * | 12/2002 | Troxtell, Jr. | 206/714 |
| 2006/0011508 | A1 * | 1/2006 | Hoegerl et al. | 206/714 |
| 2007/0119746 | A1 * | 5/2007 | Kuo | 206/714 |
| 2008/0023368 | A1 | 1/2008 | Soto | |

* cited by examiner

*Primary Examiner* — Steven A. Reynolds
(74) *Attorney, Agent, or Firm* — Erickson Law Group, PC

(57) ABSTRACT

A device and method for tape and reel packaging of small electronic components providing positioning mechanisms to allow one or more components to be placed in a desired orientation and alignment within a tape carrier pocket. The device is an insert fitting within the carrier pocket including positioning mechanisms such as protruding shapes, protruding ridges, and/or frame work, or the like, which engage with inner surfaces, outer surfaces, or perimeters, or a combination, of the component to be packaged. A method for tape and reel packaging including further delineation of regions within a tape carrier pocket for disposition of electronic components is also disclosed.

9 Claims, 10 Drawing Sheets

INSERT FOR TAPE AND REEL PACKAGING

FIELD OF THE INVENTION

This invention relates to methods for packaging electronic components, and in particular to a tape and reel packaging process.

BACKGROUND OF THE INVENTION

A tape and reel packaging system is a system often used in the electronics industry for shipping surface mount devices for automated circuit board assembly. In tape and reel packaging systems, surface mounted electronic components such as capacitors, resisters, and substrates, and other components, are deposited into specifically designed pockets in a carrier tape, which provides a continuous array of pockets. A cover tape is used to seal the pockets to keep the components in place. The tape is then wound into a reel for packaging and shipping.

The reel is loaded for use with pick-and-place machines which can easily pick up the surface mount devices for placement when the reel is unwound and after the cover tape has been peeled back from the carrier tape. Surface mount devices contained in the reel can be fed through pick-and place machines at high speeds, and in a consistent orientation because the orientation of the component as it was packaged is preserved, thus saving time and facilitating placement by machines. The use of taped products in conjunction with a pick-and-place machine eliminates the need for additional equipment, such as part alignment and orientation devices.

Tape and reel packaging systems can hold hundreds to thousands of surface mounted components or devices which requires less frequent loading, thus reducing labor and manufacturing costs.

Existing carrier tape packaging systems typically include a carrier tape with a plurality of cavities or pockets arranged in a row, such as the packaging system described in U.S. Pat. Nos. 4,606,171 and 4,657,137, wherein the same small electronic components are placed in the cavities. A backing tape is used to seal the components in place within the cavities for shipping. The backing tape may be a thin flexible gel layer such as described in U.S. Pat. No. 5,524,765, which holds the component in place securely during the packaging, transporting, and loading process. U.S. Pat. No. 4,724,958 provides a carrier tape comprising a plurality of rows of cavities.

Other tape and reel packaging systems have attempted to incorporate the packaging of more than one electronic component into one reel. U.S. Pat. No. 7,296,963 and U.S. Patent Application Publication No. 2008/0023368 discloses a tape and reel packaging system with two rows of cavities or pockets which can be used to hold the same or different electronic components. Carrier tapes may be made of paper, plastic, or an electrically conductive material, or treated to be electrically conductive so as to dissipate static electricity.

The present inventor has recognized the need for an insert for a standard tape and reel packaging system capable of holding more than one type of component in each reel, which reduces the number of individual parts that need to be stored and tracked for inventory.

The present inventor has recognized the need for an insert for a standard tape and reel packaging system which reduces the amount of time required to place components on to circuit boards and increases the efficiency of board assembly by providing for a more efficient use of tape cavity space, The present inventor has recognized the need for an insert for a standard tape and reel packaging system which locates components much closer than is possible using standard tape and reel.

The present inventor has recognized the need for an insert for a standard tape and reel packaging system which allows for several parts to be picked up at once to allow for placement onto a circuit board as a group.

SUMMARY OF THE INVENTION

An insert for a pocket in a tape and reel packaging system comprises a positioning mechanism for maintaining more than one component within the pocket in a desired orientation and alignment during packaging, shipping and removal of the components for use.

The positioning mechanism can comprise protruding shaped members, ridges, a supporting frame work, or other similar mechanisms known to one skilled in the art, for maintain a desired orientation and alignment of the components from shipping until removal of the components.

Protruding shaped members extend upward from the upward facing bottom surface of the insert to form a platform conforming to the shape of the inner bottom surface of the component. The component can be disposed onto the platform to be held in position within the carrier tape pocket. Alternatively protruding shaped members may comprise portions of the platform which come into contact with portions of the inner bottom surface of the component, and which are sufficient to maintain the component's position within the carrier tape pocket.

Alternatively, the positioning mechanism can comprise protruding ridges that extend upward from the upward facing bottom surface of the insert to form a perimeter defining a shape conforming to the inner bottom surface perimeter of the component. The components can be disposed onto the perimeter defined by the protruding ridges to be held in position within the carrier pocket. Alternatively, protruding ridges may comprise discontinuous portions of the perimeter defining the shape conforming to the inner bottom surface perimeter of the component, so long as the ridges are sufficient to maintain the component's position within the carrier tape pocket.

In another embodiment, the positioning mechanism can comprise a supporting framework which surrounds at least a portion of the perimeter of the component. The supporting framework may be in contact with as little as a minimal portion of the perimeter of the component just sufficient to maintain the component in the desired position, or the supporting framework may surround the entire perimeter of the component to form a secondary pocket for the component within the tape carrier pocket. The supporting framework may extend from the upward facing bottom surface of the insert in a manner similar to the protruding ridges, or may extend from the perimeter of the insert in a direction toward the components.

In another embodiment, a combination of protruding shaped members or ridges may be used in conjunction with a supporting frame work to position the components within the pocket. Depending on the shape and orientation of the positioning mechanism, the component may be oriented within the tape carrier pocket as desired to facilitate the simultaneous pick-and-place assembly of more than one component.

In another aspect, the invention provides a method of packaging one or more components within the pocket in a tape and reel packaging system comprising providing pockets within a carrier tape for depositing of electronic components, further delineating regions within the pocket wherein components can be disposed, positioning the components within the regions using positioning mechanisms to ensure that the orientation and alignment of the components are maintained throughout the packaging, shipping and removal of the component. The step of further delineating regions within the pocket may comprise forming a secondary pocket with side walls which come into contact with at least a portion of the outer surface of the component. Alternatively the step of further delineating regions within the pocket may comprise forming shaped protrusions which come in contact with portions of the inner bottom surface and/or portions of the inner bottom surface of the component. The step of positioning the components within the regions using the positioning mechanisms comprises the step of disposing the components in contact for engagement with the position mechanisms.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
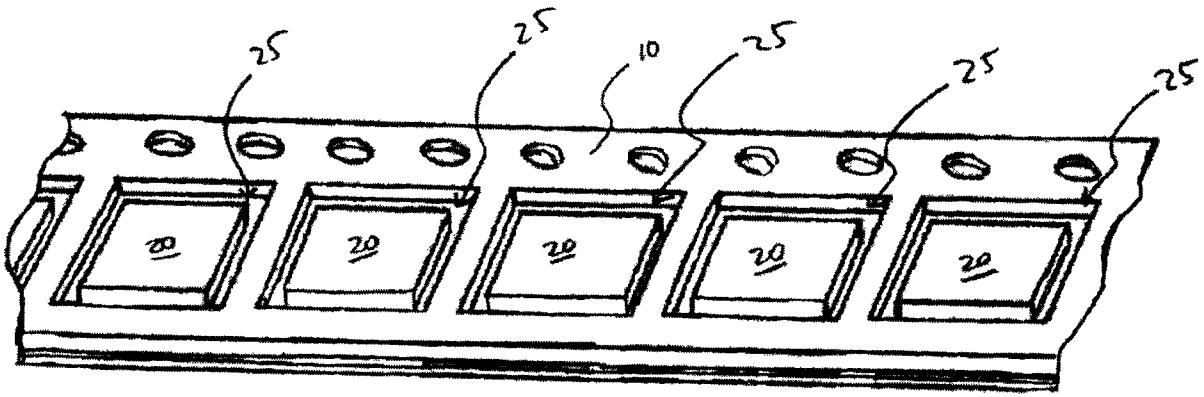
FIGURE 1 Prior Art
FIG. 1 is a perspective view of an example of a prior art tape packaging system.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a prior art carrier tape 10 with small components 20 disposed within a plurality of cavities 25.

Figure 2:
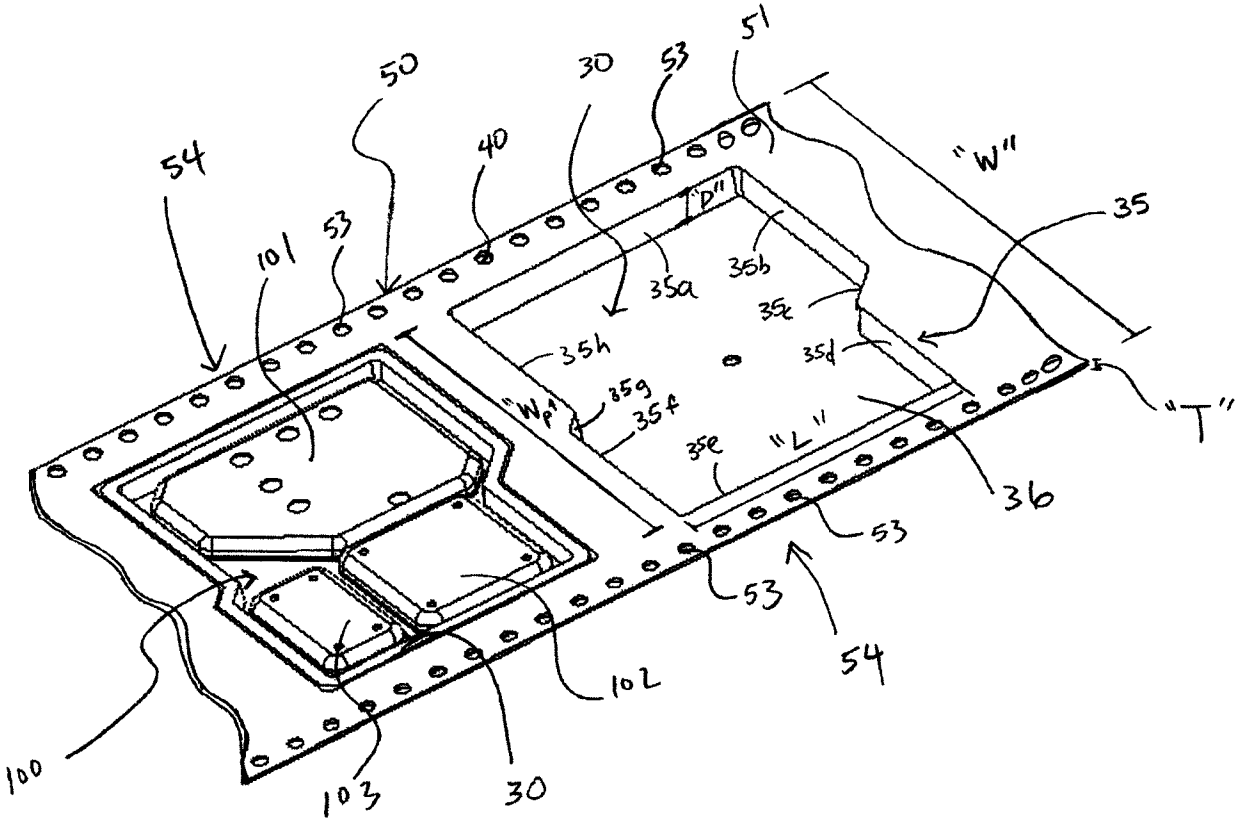
FIG. 2 is a perspective view of a tape packaging system using an exemplary embodiment of the insert of the present invention.

FIG. 2 illustrates an insert 100 within a cavity or pocket 30 in a carrier tape 50 which allows multiple components 101, 102, 103 to be fitted within a pocket 30.

Carrier tape 50 is a continuous smooth ribbon-like film with a front side 51 and a back side 52 (FIG. 5) and having a width "W" and a thickness "T" which are selected to suit the size and weight requirements of electronic components, for example components 101, 102, 103, that are disposed within the pocket 30. The carrier tape 50 may be made of plastic, such as polyester, polyvinyl chloride (PVC), and the like, or plain paper. The carrier tape 50 is preferably constructed with the ability to minimize or absorb tension and compression experienced during the packaging process so as to minimize disturbance to electrical components.

An electrically conductive carrier tape is preferably used for carrying electronic components which may be susceptible to damage due to an electrostatic charge. A carrier tape may be made electrically conductive, for example, by mixing carbon into a foamed plastic, such as polyethylene.

Figure 5:
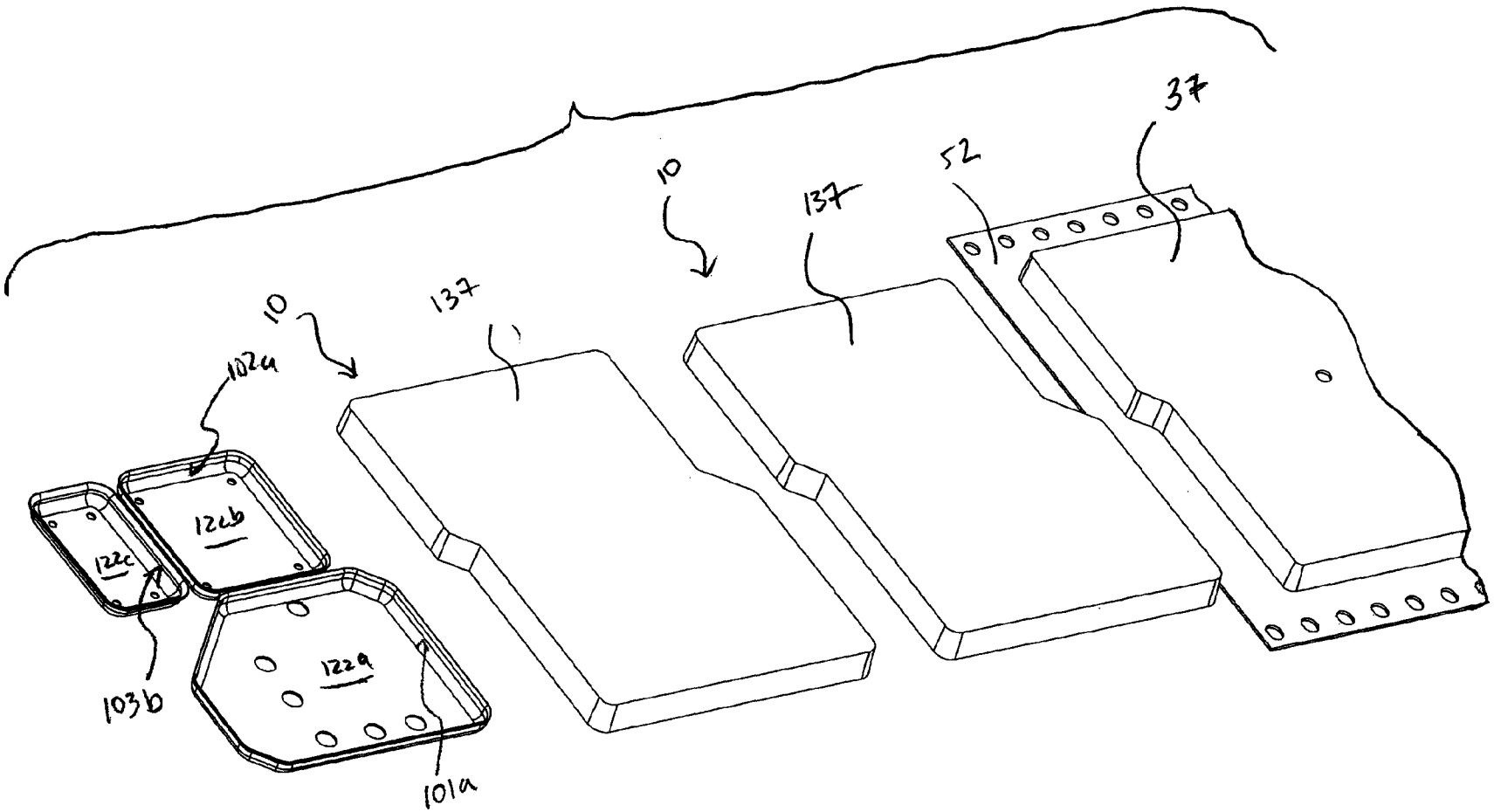
FIG. 5 is an exploded perspective view of the bottom side of the various parts of the tape packaging system shown in FIG. 3.

The pockets 30 in the carrier tape 50 can be formed by punching pockets into the carrier tape, or alternatively, can be vacuum formed. Pockets 30 are formed with a depth "D", pocket width "$W_p$", and a length "L" to suit the dimensions of the components being packaged. Pockets 30 have a perimeter 35 defined by side walls 35*a*, 35*b*, 35*c*, 35*d*, 35*e*, 35*f*, 35*g*, 35*h* all having a height "D" which defines the depth of the pocket 30. Pockets 30 have an upward facing bottom surface 36, and a downward facing bottom surface 37 as illustrated in FIG. 5. Sprocket holes 53 are punched into the side edges 54 of the carrier tape 50. The sprocket holes 53 engage gear teeth on packaging or assembly machinery to allow the carrier tape 50 to be moved or unwound in a desired direction.

Once electrical components are placed within the pockets 30, a cover tape (not shown) is disposed in contact with the front side 51 of the carrier tape 50 to seal the components within the pockets 30 in the carrier tape 50. The cover tape (not shown) adheres to at least a portion of the perimeter 35 of the pockets. The carrier tape 50, containing electrical components in the pocket 30 which are sealed within the pockets 30 by a cover tape, is then wound into a reel for packaging. The cover tape may be made of plain crepe paper, plastic, or a combination thereof, or any other suitable material known to one skilled in the art.

To unwind the reel, a leading portion of the carrier tape 50 is fed into automated assembly machinery where gear teeth engage with the sprockets 53 to unwind the reel and provide a continuing supply of electrical components to the pick-and-place machinery. The cover tape is peeled from the carrier tape 50 by the automatic placement equipment to expose the electronic component which is then picked up by the placement machinery for assembly.

Figure 3:
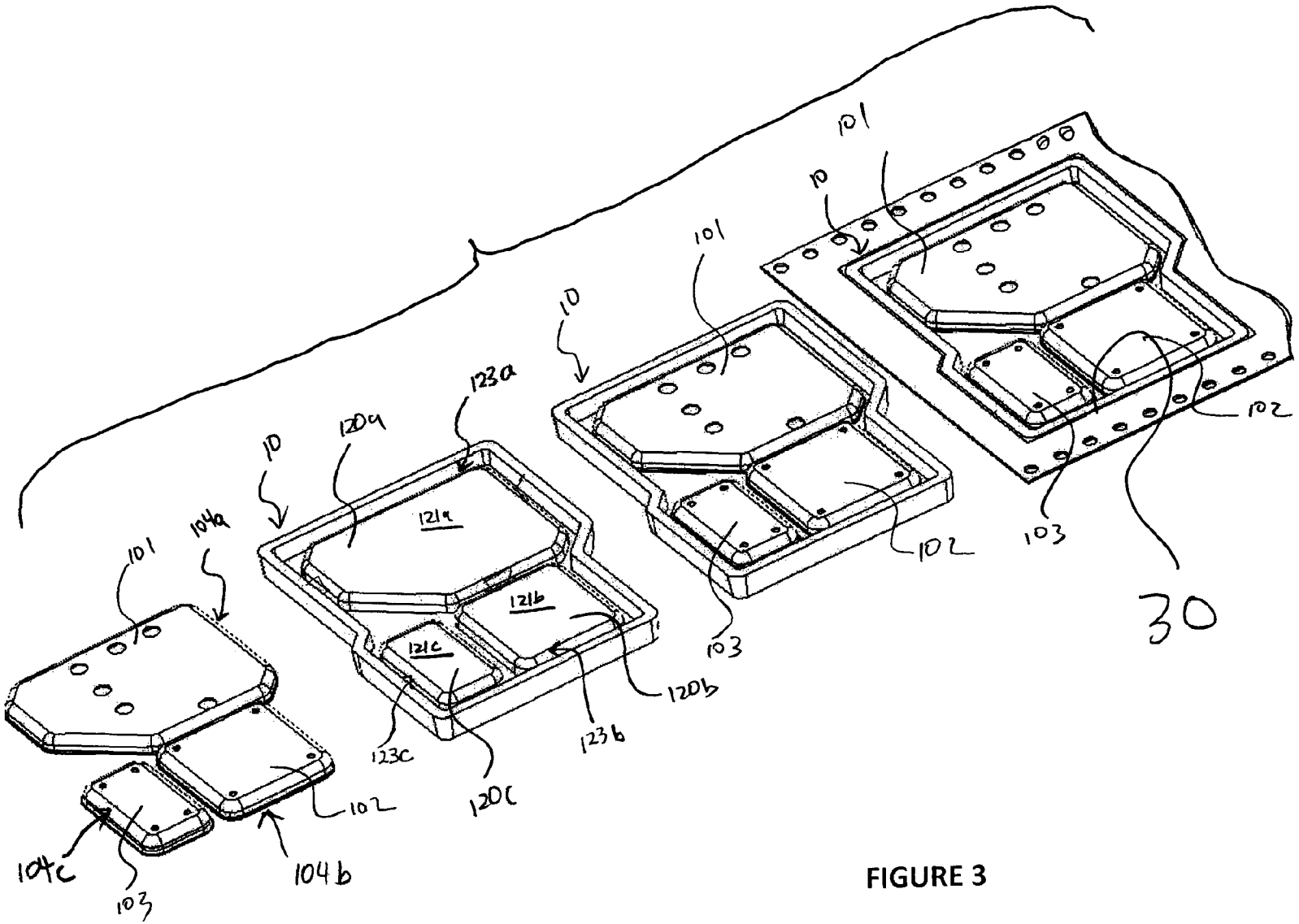
FIG. 3 is an exploded perspective view of the various parts of the tape packaging system, with the insert and components removed from the tape pocket for clarity.
Figure 4:
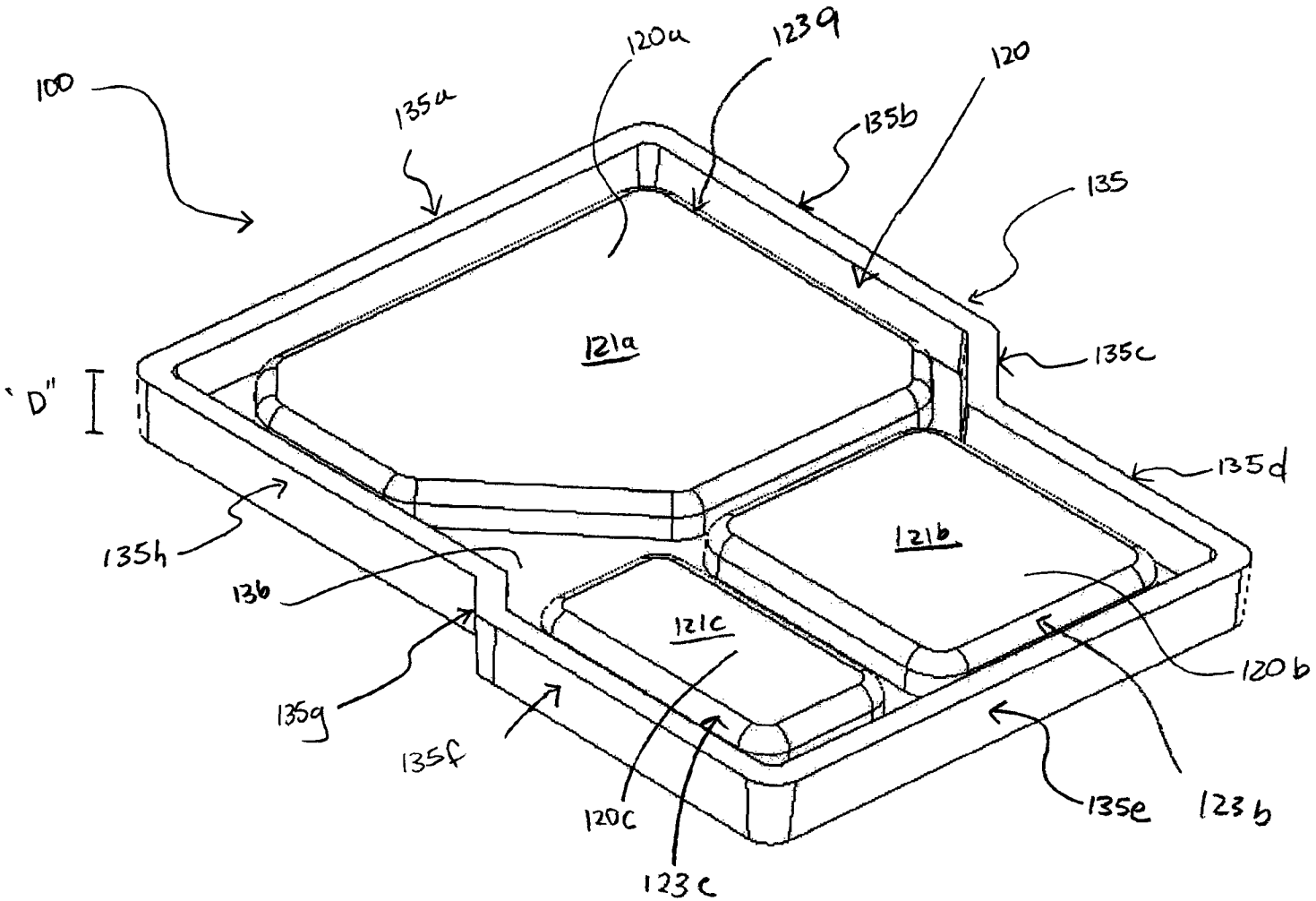
FIG. 4 is an enlarged perspective view of the insert.

As illustrated in FIGS. 2, and 3, multiple components 101, 102,103 may be placed within one pocket 30 through the use of an insert 100 which prevents the components 101,102, 103 from shifting within the pocket 30. Insert 100, is shaped to fit into a pocket 30, and has a perimeter 135 defined by side walls 135*a*, 135*b*, 135*c*, 135*d*, 135*e*, 135*f*, 135*g*, 135*h* as illustrated in FIG. 4. Side walls 135*a*, 135*b*, 135*c*, 135*d*, 135*e*, 135*f*, 135*g*, 135*h* have a height "D" corresponding to the depth of the pocket 30, such that the insert does not extend over beyond the side walls of the pocket 30. Alternatively, the insert may be of a height less than "D". The insert 100 further comprises an upward facing bottom surface 136, and downward facing bottom surface 137 (FIG. 5) which comes into contact with the upward facing surface 36 of the pocket 30 when the insert 100 is in the pocket 30.

The insert 100 comprises a component positioning mechanism, which in the embodiment illustrated in FIG. 4, comprises a plurality of protruding shaped members 120 which extend upward from the upward facing bottom surface of the insert 136. Each protruding shaped member 120*a*, 120*b*, 120*c* is shaped to provide support and to position components 101, 102, 103 respectively. Protruding shaped members 120*a*, 120*b* 120*c* are shaped to respectively receive components 101, 102, 103, which are disposed over the protruding shaped members 120. Protruding members are formed slightly smaller, and proportional in size to the components it intends to support, so that the components can be fitted over the protruding members such that the inner bottom surface 122*a*, 122*b*, and 122*c* of the components and their respective inner bottom surface perimeters 101*a*, 102*a*, 103*a* comes into contact with the platform surfaces 121*a*, 121*b*, 121*c* of the protruding members 120*a*, 120*b*, 120*c*, and their respective perimeters 123*a*, 123*b*, 123*c* (FIGS. 3 and 4) to form a fit that prevents components from shifting. Surfaces 121*a*, 121*b*, 121*c* are substantially flat, and are parallel, depending on the type of component being positioned, to the upward facing bottom surface 136. Alternatively, surfaces 121*a*, 121*b*, 121*c* may conform to the shape of components as required, and need not necessarily be flat or parallel to the upward facing bottom surface. As illustrated in FIG. 5, the downward bottom surface 137 of the insert 100 is flat. Alternatively, the protruding shaped members may be made by stamping out, in an upward direction, the desired shape from the downward bottom surface 137 of the insert 100. Protruding shaped members work best with components which can be placed and fitted over the protruding shaped members.

Figure 4A:
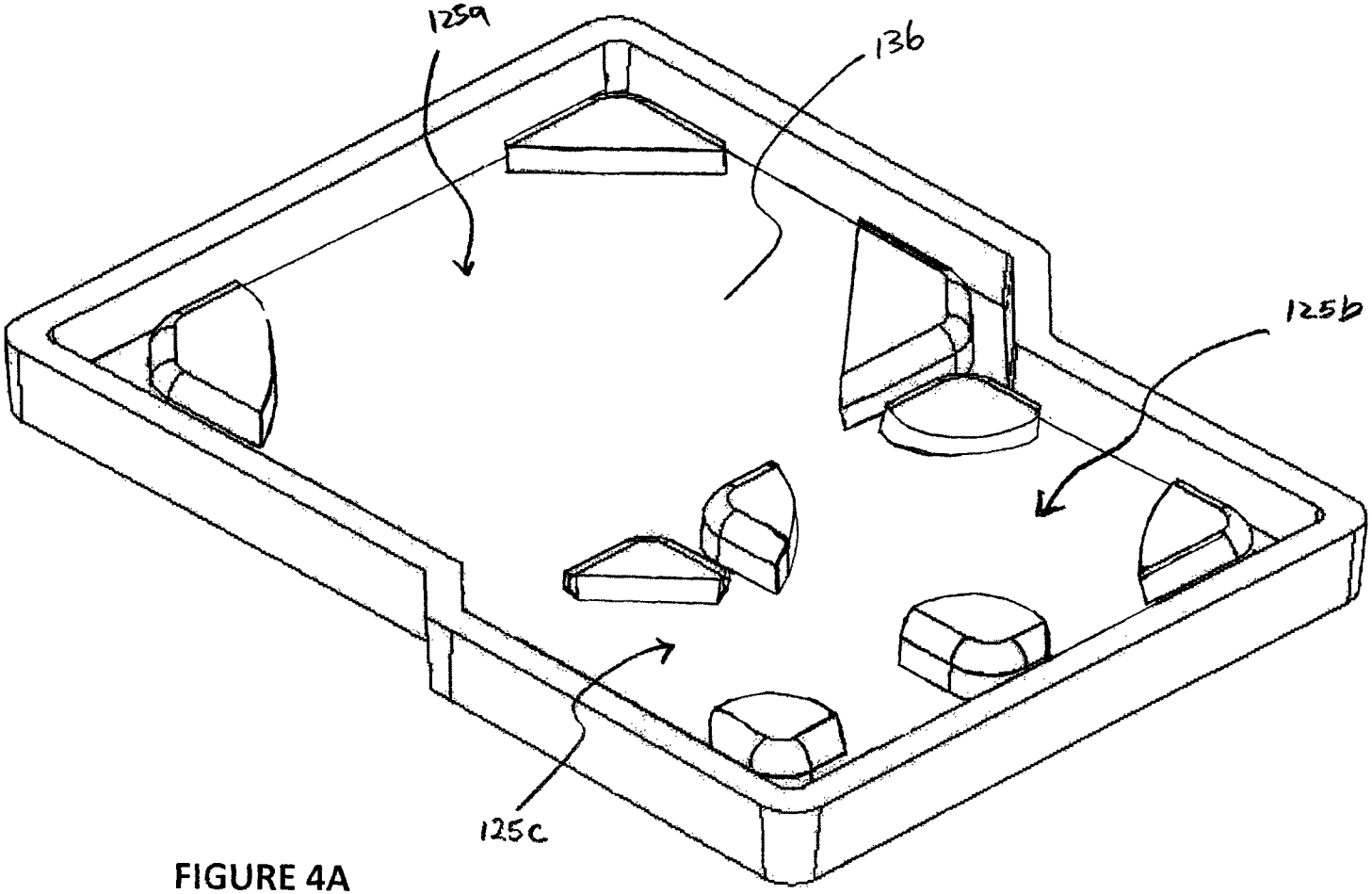
FIG. 4A is a perspective view of an alternate embodiment of the insert.

In an alternate embodiment, as illustrated in FIG. 4A, protruding shaped members may be shaped members which only come in contact with a portion of the inner bottom surface 122*a*, 122*b*, 122*c* of the components and a portion of the inner bottom surface perimeter 101*a*, 102*a*, 103*a* of the components.

Figure 6:
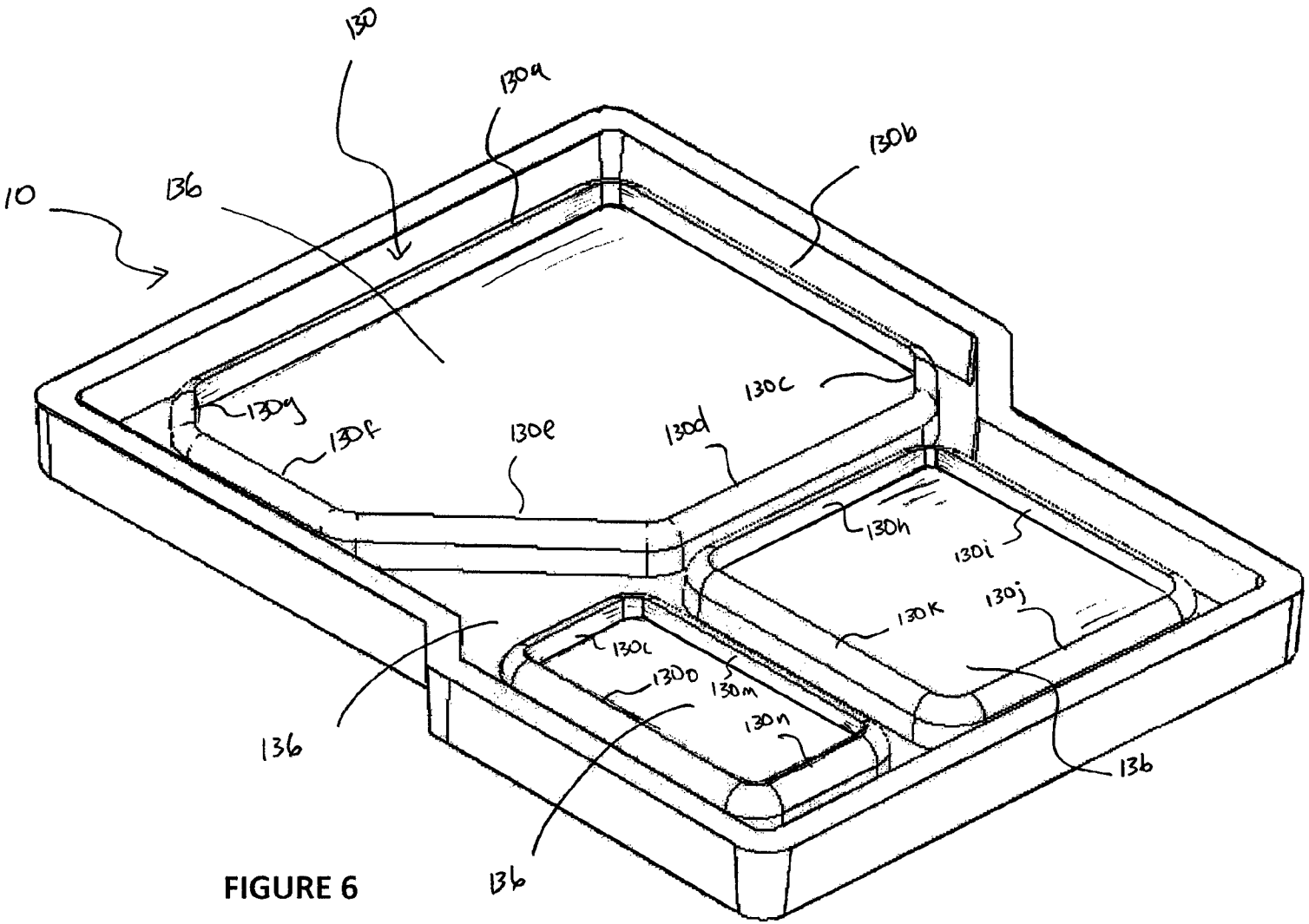
FIG. 6 is a perspective view of another embodiment of the insert.

FIG. 6 illustrates an alternative embodiment of the insert, wherein the component positioning mechanism comprises protruding ridges 130 that form a perimeter defining a shape conforming to the inner bottom surface perimeter 101*a*, 102*a*, 103*b*, of the components, similar to the perimeter 123*a*, 123*b*, 123*c* illustrated in FIG. 4. Protruding ridges 130*a*, 130*b*, 130*c*, 130*d*, 130*e*, 130*f*, 130*g* define a perimeter shaped to receive component 101, while ridges 130*h*, 130*i*, 130*j*, 130*k*, and ridges 130*l*, 130*m*, 130*n*, 130*o* define perimeters shaped to receive components 102, 103 respectively. The protruding ridges 130*a*, 130*b*, 130*c*, 130*d*, 130*e*, 130*f*, 130*g*; 130*h*, 130*i*, 130*j*, 130*k*; and 130*l*, 130*m*, 130*n*, 130*o* come into contact with inner bottom surface perimeters 101*a*, 102*a*, and 103*a* respectively.

In an alternate embodiment (not shown), the positioning mechanism may comprise protruding ridges that form discontinuous portions of the perimeter defining the shapes that conform to the inner bottom surface perimeter 101*a*, 102*a*, 103*a*, of the components. The discontinuous protruding ridges come into contact with a portion of the inner bottom surface perimeters 101*a*, 102*a*, 103*a*, in manner analogous to how the portions of the protruding shaped members shown in FIG. 4A come into contact with portions of the inner bottom surface and portions of the inner bottom surface perimeter of the components. The portions of the protruding ridges can be used to define a discontinuous perimeter capable of supporting a component. For example ridge 130*f*, 130*b*, and 130*d*, or portions thereof, can be used to define a discontinuous perimeter that is still capable of coming in contact with portions of the inner bottom surface perimeter 101*a* of the component 101. The protruding ridges that come into contact with at least a portion of the bottom surface perimeter of the component can also be punched out from the downward facing bottom surface 137 of the insert. In another embodiment, the protruding ridges forming either a continuous or discontinuous shaped perimeter can provide a supporting framework within which a component may be disposed. Thus, instead of disposing a component such that portions of the inner bottom surface perimeter come into contact with the protruding ridges, it is the exterior perimeter 104*a*, 104*b*, 104*c* of components 101, 102, 103 respectively that come into contact with the protruding ridges illustrated in FIG. 6. Such a supporting framework may extend from the upward facing bottom surface as illustrated in FIG. 6, or may be formed by continuously extending the perimeter of the insert 135, in a direction towards the components to define secondary pockets for the components as illustrated in FIG. 7.

Figure 7:
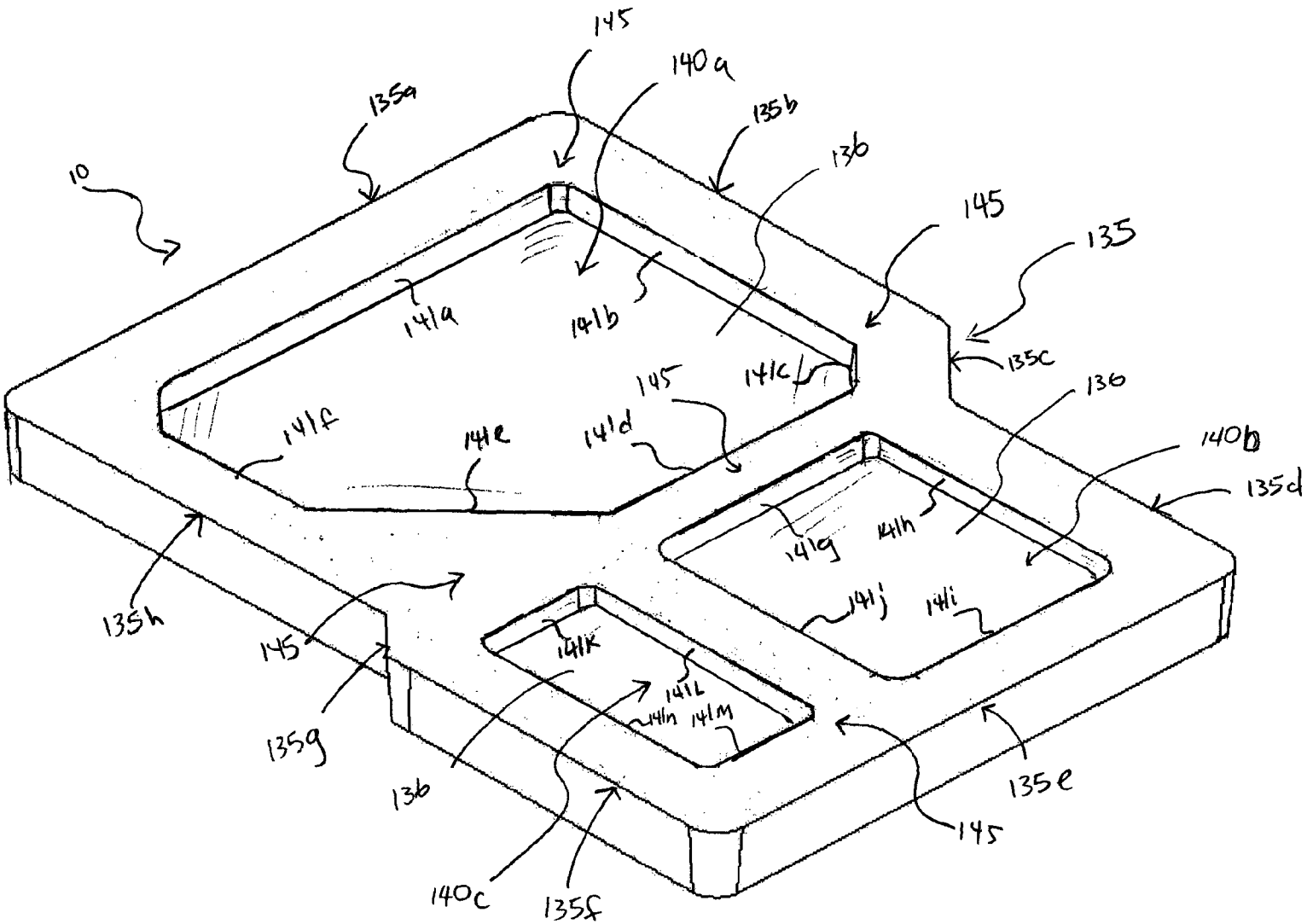
FIG. 7 is a perspective view of yet another embodiment of the insert.

FIG. 7 illustrates another embodiment of the present invention wherein the positioning mechanism comprises a framework 145 which forms secondary pockets 140*a*, 140*b*, 140*c* within the insert 100 to further define the positioning of the electrical components 101, 102, 103 within the tape pocket 30. The secondary pockets 140*a*, 140*b*, 140*c* may have an upward facing bottom surface 136 as illustrated, or the secondary pockets 140*a*, 140*b*, 140*c* may be defined only by framework 145 without the upward facing bottom surface 136, in which case upward facing bottom surface 36 of the pocket 30 serves as the bottom surface of the secondary pockets 140*a*, 140*b*, 140*c*. Framework 145 comprises pocket side walls 141*a*, 141*b*, 141*c*, 141*d*, 141*e*, 141*f*; 141*g*, 141*h*, 141*i*, 141*j*; and 141*k*, 1411, 141*m*, 141*n* of the secondary pockets 140*a*, 140*b*, 140*c* respectively.

In an alternative embodiment, the framework 145 may be minimized by removing portions of side walls not crucial to positioning the components within the insert 100. The insert 100 illustrated in FIG. 8 maintains the perimeter 135 defined by side walls 135*a*, 135*b*, 135*c*, 135*d*, 135*e*, 135*f*, 135*g*, 135*h* (FIGS. 4 and 7) but has portions of the framework 145, seen in its entirety in FIG. 7, removed. In the embodiment illustrated in FIG. 9, the insert maintains a portion of each of the side walls 135*a*, 135*b*, 135*c*, 135*d*, 135*e*, 135*f*, 135*g*, 135*h*, and a portion of the framework 145 of FIG. 7 to provide a framework 160 which continuously connects a portion of the perimeter of each cavity 140*a*, 140*b*, 140*c* illustrated in FIG. 7. The framework 160 defines regions 160*a*, 160*b*, 160*c* which are used to position components 101, 102, 103 respectively. The framework 160 can have a bottom surface (not shown) connected to framework, or alternatively, the bottom surface supporting the components is provided by the upward facing bottom surface 36 of the carrier tape pocket 30.

Figure 8:
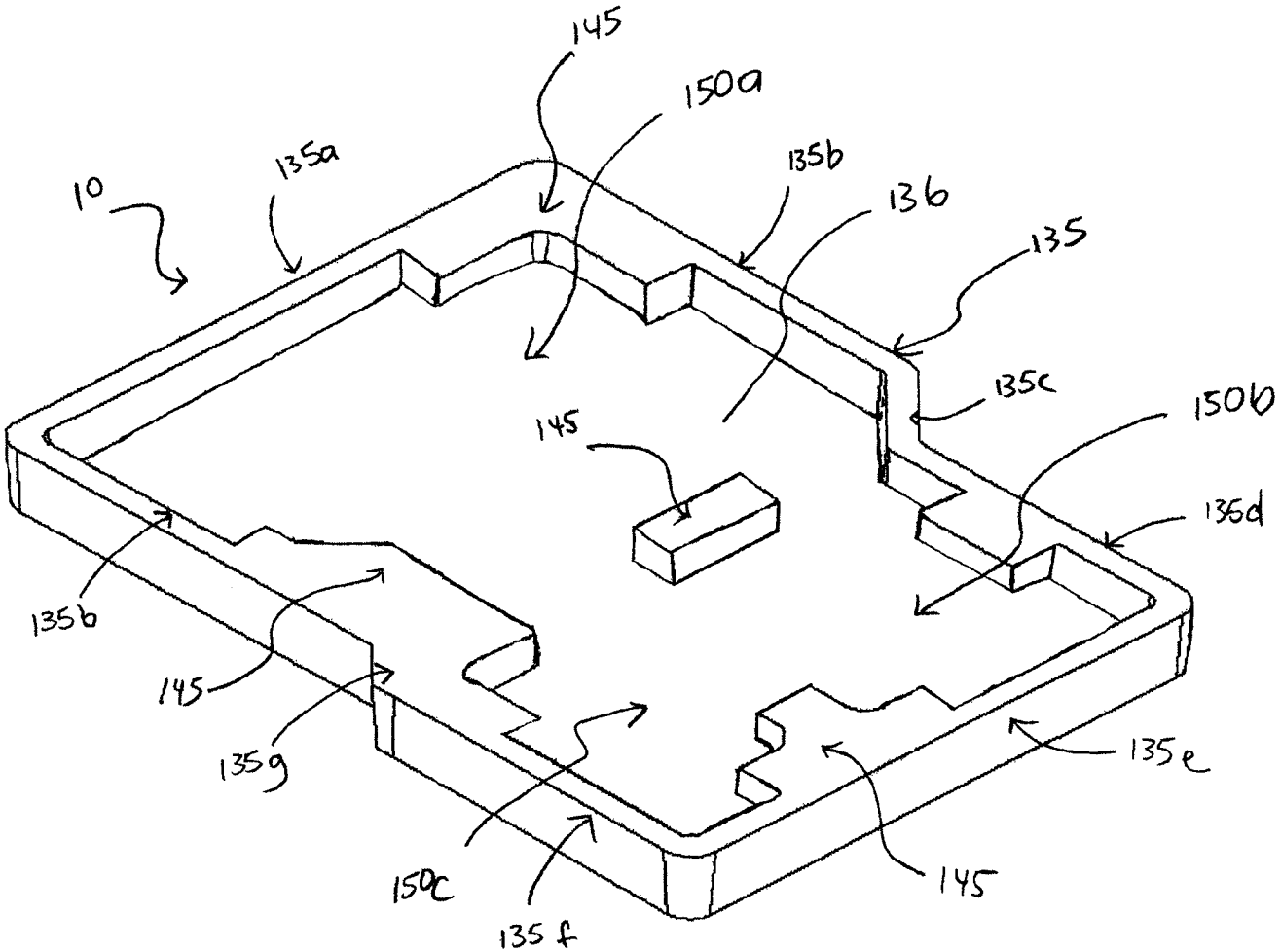
FIG. 8 is a perspective view of another embodiment of the insert.
Figure 9:
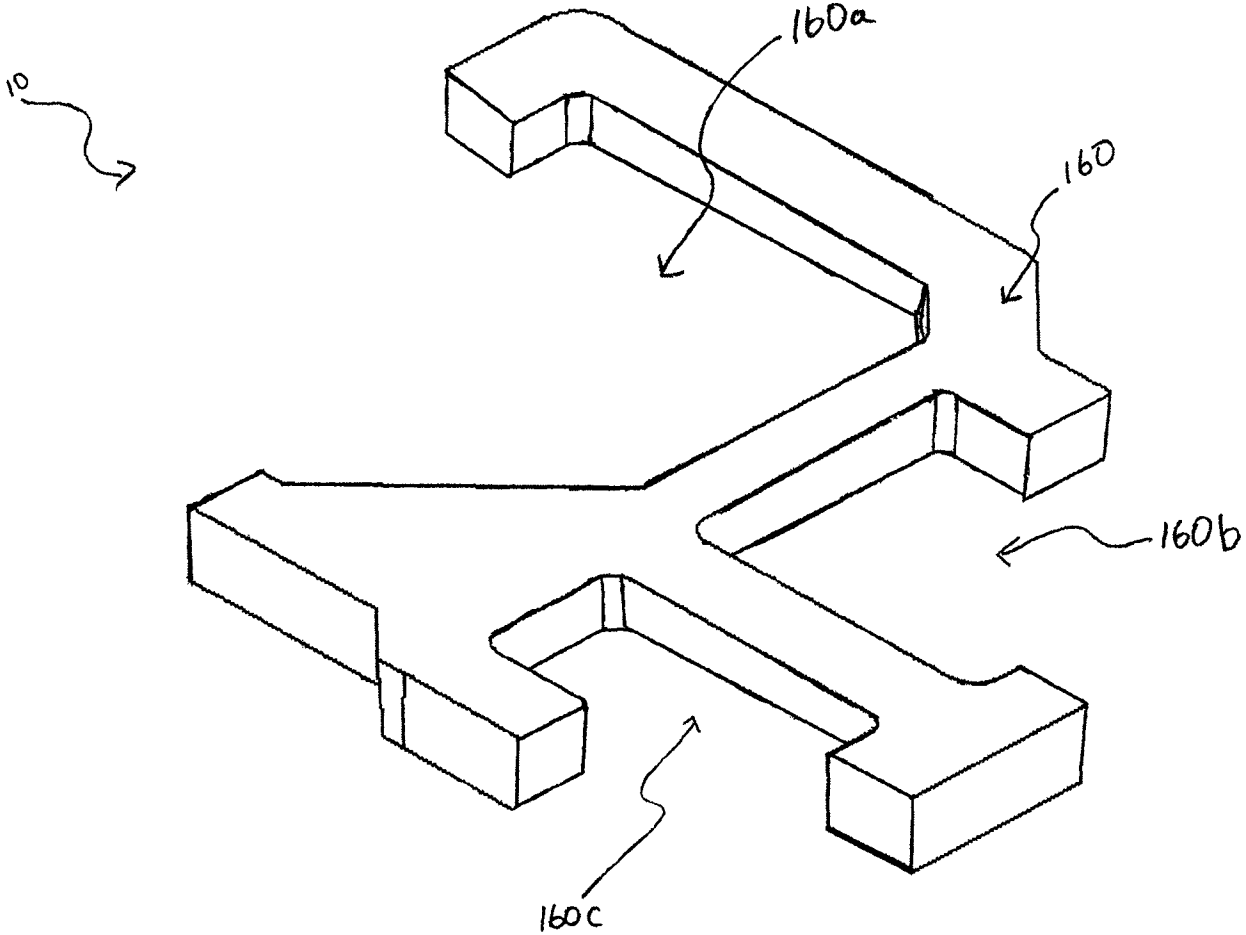
FIG. 9 is a perspective view of an alternate embodiment of the insert.

In another embodiment, the embodiment of FIG. 8 may comprise only portions of the side walls 135*a*, 135*b*, 135*c*, 135*d*, 135*e*, 135*f*, 135*g*, 135*h* in a manner analogous to that illustrated in FIG. 9. Combinations of the embodiments maybe used to create an insert that suits the packaging needs of the component.

In use, the method of packaging one or more components using a tape and reel packaging system comprises the step of providing pockets within a carrier tape for deposition of electronic components, further delineating regions within the pocket wherein components can be disposed, positioning the components within the regions using positioning mechanisms to ensure that the orientation and alignment of the components do not change during the packaging, shipping and removal of the component. The delineated regions within the pocket do not move relative to the carrier tape pocket. The step of further delineating regions within the pocket may comprise forming a secondary pocket with side walls which come into contact with at least a portion of the outer surface of the component. Alternatively the step of further delineating regions within the pocket may comprise forming protrusions which come in contact with portions of the inner bottom surface and/or portions of the inner bottom surface of the component. The step of positioning the components within the regions using the positioning mechanisms comprises the step of disposing the components in contact for engagement with the position mechanisms.

The insert may be made of plastic, such as polyester, polyvinyl chloride (PVC), and the like, or plain paper. The insert may be made of the same or different material as the carrier tape. Insert material may be selected in conjunction with tape carrier material to provide desirable mechanical properties such as the ability to absorb or minimize tension, compression, vibration, and other stresses experienced by the components in the packaging.

The parts which may be grouped together for placement within a pocket are not limited to metal stampings. Any board level component, such as connectors, microphones, and contacts can be added to the group. Any board level component may be oriented and aligned as desired, depending on the arrangement of the positioning mechanisms on the insert.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. An insert for use within the pocket of a carrier tape in a standard tape and reel packaging system, the pocket being defined by pocket side walls, comprising:

insert sidewalls which are separate from the pocket of the carrier tape;

a positioning mechanism within the insert sidewalls to position more than one component within the pocket of the carrier tape and for ensuring components remain in a desired orientation and alignment relative to each other and relative to the pocket;

wherein the insert is shaped such that at least a portion of a perimeter of the insert can be in contact with portions of the pocket sidewalls; and wherein the positioning mechanism comprises protruding shaped members extending from an upward facing bottom surface of the insert, the protruding shaped members having top and side surfaces configured such that a component can be disposed onto the protruding shaped members with at least a portion of an inner bottom surface of the component and at least a portion of an inner bottom surface perimeter of the component are in contact with the top and side surfaces of the protruding shaped members; and wherein the protruding shaped members are connected via the bottom surface to the insert sidewalls.

2. The insert of claim 1, wherein a group of the protruding shaped members have spaced apart top and side surfaces that define a discontinuous perimeter that is configured such that a single component can be disposed onto the group with at least a portion of an inner bottom surface of the single component and at least a portion of an inner bottom surface perimeter of the single component are in contact with the spaced apart top and side surfaces of the group, the discontinuous perimeter being slightly smaller than the inner bottom surface perimeter of the component.

3. The insert of claim 1, wherein at least one of the protruding shaped members has a top and side surface defining a continuous perimeter that is configured such that a single component can be disposed on the one protruding shaped member wherein the continuous perimeter is slightly smaller than an inner bottom surface perimeter of the one component to fit therein.

4. The insert of claim 1 wherein the insert sidewalls are continuous and surround the protruding shaped members.

5. A method of packaging one or more components within a pocket of a carrier tape in a standard tape and reel packaging system comprising the step of:

providing pockets within a carrier tape for depositing of electronic components;

providing a separate insert and placing the insert within each pocket wherein the insert delineates regions within the pocket wherein components can be disposed, using positioning mechanisms; and positioning the components within the regions using the positioning mechanisms to ensure that the orientation and alignment of the components are maintained within the pocket; and wherein the step of providing a separable insert comprises forming protrusions which come in contact with portions of an inner bottom surface and/or with portions of an inner bottom surface perimeter of the component.

6. The method of claim 5 wherein the step of positioning the components within the regions using the positioning mechanisms further comprises the step of disposing the components in contact for engagement with the positioning mechanisms.

7. The method of claim 5 wherein the step of providing a separable insert comprises forming protrusions which come in contact with portions of an inner bottom surface and with portions of an inner bottom surface perimeter of the component.

8. The method of claim 5 wherein the step of providing a separable insert comprises forming one protrusion shaped member that has a platform perimeter slightly smaller than an inner bottom surface perimeter of a single component; and the step of positioning the components within the regions is further defined in that the single component is placed onto the one protrusion shaped member with the platform perimeter fitting within the inner bottom surface perimeter.

9. The method of claim 5 wherein the step of providing a separable insert comprises forming a group of spaced-apart protrusion shaped members that have a discontinuous perimeter slightly smaller than an inner bottom surface perimeter of a single component; and the step of positioning the components within the regions is further defined in that the single component is placed onto the group of protrusion shaped members with the discontinuous perimeter fitting within the inner bottom surface perimeter of the single component.

* * * * *